United States Patent [19]

Faber et al.

[11] Patent Number: 4,720,928

[45] Date of Patent: Jan. 26, 1988

[54] COMBINATION OF SNOWSHOE AND HARNESS

[76] Inventors: Guy Faber, 550 Desportes, Neutachel, Quebec; Richard Faber, 276 Cloutier, Loretteville, Quebec, both of Canada

[21] Appl. No.: 923,047

[22] Filed: Oct. 24, 1986

[51] Int. Cl.[4] ..... A63C 13/00

[52] U.S. Cl. ..... 36/122; 36/125; 280/616

[58] Field of Search ..... 36/122–125, 36/117, 7.5, 7.6; 280/616, 11.3, 11.31

[56] References Cited

U.S. PATENT DOCUMENTS

| | | | |
|---|---|---|---|
| 982,053 | 1/1911 | Haefer . | |
| 992,610 | 5/1911 | Smith . | |
| 1,613,576 | 1/1927 | Burgess | 36/125 |
| 2,299,541 | 10/1942 | Harwick . | |
| 2,511,087 | 6/1950 | Villemur . | |
| 2,516,238 | 7/1950 | Mortsell . | |
| 2,643,888 | 6/1953 | Hargis, Jr. | 280/616 |
| 2,699,613 | 1/1955 | Peterson . | |
| 2,738,596 | 3/1956 | Walsh | 36/124 |
| 2,987,834 | 6/1961 | Howe . | |
| 3,000,117 | 9/1961 | Howe . | |
| 3,299,541 | 1/1967 | Snyder . | |
| 3,344,538 | 10/1967 | Massicotte . | |
| 3,555,707 | 1/1971 | Sharratt et al. . | |
| 3,638,333 | 1/1972 | Sprandel . | |
| 4,085,529 | 4/1978 | Merrifield . | |
| 4,259,793 | 4/1981 | Morgan et al. . | |
| 4,271,609 | 6/1981 | Merrifield . | |
| 4,348,823 | 9/1982 | Knapp et al. | 36/123 |

FOREIGN PATENT DOCUMENTS

| | | | |
|---|---|---|---|
| 993468 | 7/1976 | Canada . | |
| 1074356 | 3/1980 | Canada . | |
| 2477025 | 9/1981 | France | 36/122 |
| 250090 | 5/1948 | Switzerland | 280/616 |

*Primary Examiner*—James Kee Chi

*Attorney, Agent, or Firm*—Nixon & Vanderhye

[57] ABSTRACT

A snowshoe is provided with a transverse steel cable that engages the opposite longitudinal side members of its frame structure. A harness secured to this cable consists of two jaw members which are pivotally connected to one another at one end thereof and cooperate to clamp the edge of the front sole portion of a user's boot. A rubber strap is attached at its opposite ends to one of the jaw members for further securing the boot to the harness. The decking of the snowshoe has an opening to allow the pivotal movement of the front portion of the boot during use. The jaw members have finger-engaging portions to facilitate the mounting and dismounting of a boot to and from the harness.

20 Claims, 7 Drawing Figures

COMBINATION OF SNOWSHOE AND HARNESS

FIELD OF THE INVENTION

The present invention pertains to an improved combination of a snowshoe and of a harness; more particularly, the present invention pertains to a combined snowshoe and harness arrangement wherein the harness is of the type used for mounting on cross-country skis.

BACKGROUND OF THE INVENTION

There exists a wide variety of snowshoes, many of which employ wooden frames, others employing metal frames. Similarly, the webbing used in many snowshoes consists of a network of wooven strands of rawhide or, in some cases, of synthetic polymeric material. Some deckings are molded entirely of a relatively rigid plastic.

Similarly, there are also many types of harnesses which are devised to secure a shoe or boot to a snowshoe. Most of these harnesses consist of an arrangement of straps which encircle the shoe or boot and which are secured to either the network of webbing or the decking. One example of such an arrangement is described in Canadian Pat. No. 993,468 issued July. 29, 1976 to Prater.

Attempts have also been made to mount on snowshoes a harness of the type used on cross-country skis. One example of such arrangement is described in Canadian Pat. No. 1,074,356 issued Mar. 25, 1980 to Gros-Louis. However, the combination described in this patent requires improvement: while walking with snowshoes, the user needs to lift the front end of the snowshoe at the start of a step and then move the snowshoe forward. As the snowshoe is lifted, relative movement between the snowshoe and the boot occurs. In order to permit this movement, it is essential that an opening be provided in the snowshoe webbing or decking to allow the front end of the boot to pivot in the opening as the snowshoe reaches an upwardly inclined position relative to the ground (the tail end of the snowshoe usually dragging behind in the snow); the snowshoe and the user's boot then return to a horizontal plane as the user returns his foot on the ground. The relative movement between boot and snowshoe cannot be achieved with the arrangement described in the above Gros-Louis patent.

OBJECTS AND STATEMENT OF THE INVENTION

It is an object of the present invention to provide a novel combination of a snowshoe and harness which overcomes the above-described problems associated with the prior art snowshoes of the type having a harness especially adapted to receive shoes or boots of the cross-country skying type.

It is a further object of the present invention to provide a combination where the user's boot can be quickly engaged to and disengaged from the harness, thereby avoiding the use of many straps as in other prior art snowshoe arrangements.

It is a further object of the present invention to provide an improved snowshoe and harness which is simple and inexpensive to manufacture, and light and easy to use.

It is a further object of the present invention to provide a combination of a snowshoe and a cross-country ski type harness where relative movement between the boot and the snowshoe occuring when the user lifts his foot during walking is not hindered.

The present invention therefore relates to the novel combination of a snowshoe and harness, in which the snowshoe comprises: a frame structure, a decking attached to the structure and a flexible bridging member extending transversely of the snowshoe in an opening provided in the decking. The harness of the novel combination is mounted to the bridging member and comprises upper and lower jaw members which are adapted to engagedly receive therebetween the front edge portion of the sole of a user's boot. The harness has clamp means fixed to the underface of the lower jaw member fixedly securing the harness to the bridging member. The harness also includes cooperating means on each jaw member to maintain the members together in engagement with the edge of the sole of the user's boot. To further secure the boot to the harness, a strap extends over the front portion of the boot and has its opposite ends connected to one of the jaw members of the harness.

With this novel arrangement, the boot with the jaw members form a whole which is allowed to pivot about a transverse axis defined by the flexible bridging member.

In one preferred form of the invention, the engagement of the jaw members to one another with the edge of the sole is effected by inter-locking portions provided at the free extremities of the jaw members.

In another preferred form of the invention, the lower member is provided with cleats therebeneath for assisting the user in walking on an icy surface.

In another embodiment of the invention, a heel plate is mounted to the decking to receive the heel of the user's boot. This heel member is preferably provided with cleats therebeneath.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
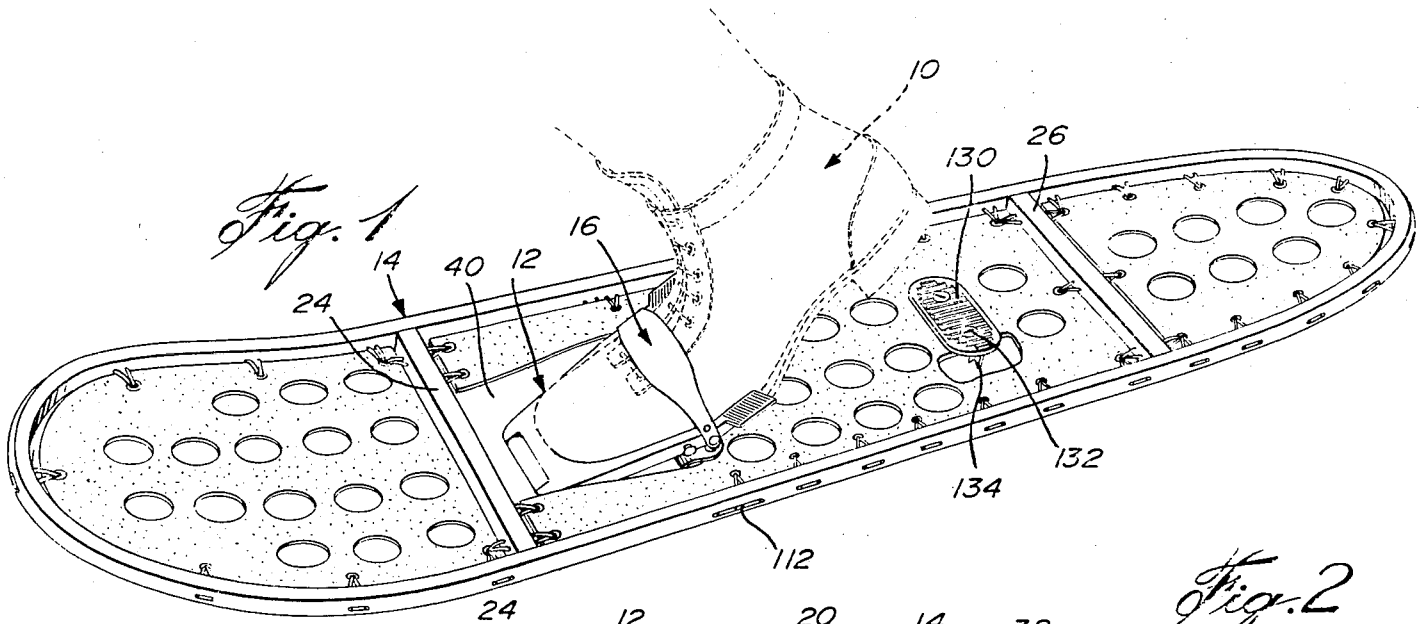
FIG. 1 is a top perspective view of the snowshoe and harness combination of the present invention with the harness in engagement with a user's boot shown in dotted lines.
Figure 2:
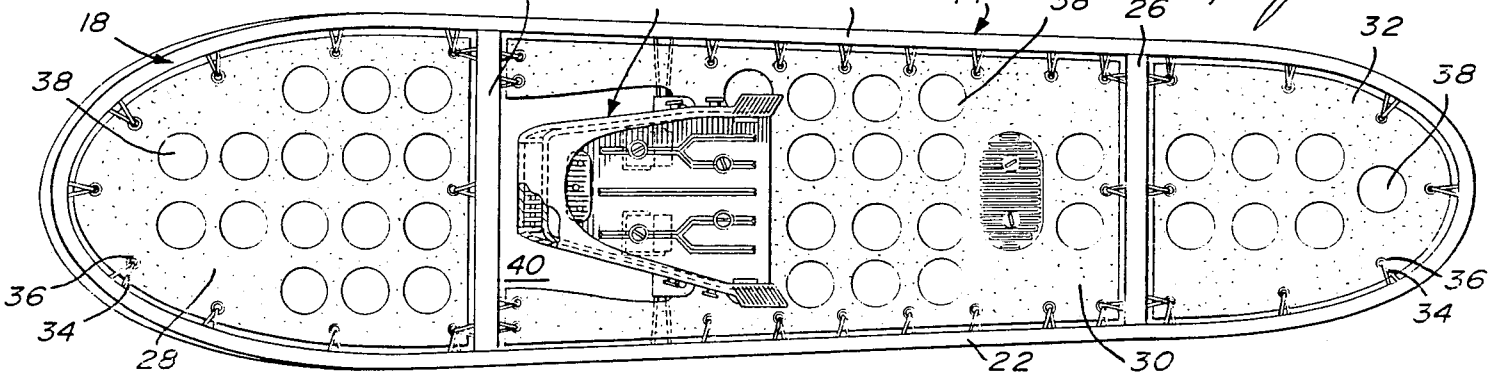
FIG. 2 is a top view of the snowshoe and harness combination.

Referring to FIGS. 1 and 2, there is shown, in dotted lines, a user's boot 10 mounted in a harness 12, both in pivoted position relative to a snowshoe 14. A strap 16 further secures the user's boot to the harness 12.

The snowshoe 14 has a structural frame that includes a peripheral frame 18 consisting of two longitudinal side portions 20 and 22. The construction of this structural frame is conventional and will not be described in detail; it can be said that it is preferably made of wood, but a metal frame could also be used. The structural frame also includes two longitudinally-spaced cross-members 24 and 26 that divides the snowshoe in three sections, i.e. a forward section which is slightly upturned, a middle section and a rear section. These sections display respective deckings 28, 30 and 32 which may consist of a resin-impregnated fabric or a laminate structure of leather and plastic; but it should be understood that it may also be a conventional webbed decking. In the embodiment illustrated in the drawings, an arrangement of plastic filament ties 34 and metallic eyelets 36 is used to secure the deckings to the structural frame of the snowshoe.

The deckings 28, 30 and 32 each display a series of circular holes 38; however, in the middle decking 30, a large opening 40 is provided and receives the toe portion of the user's boot.

Figure 3:
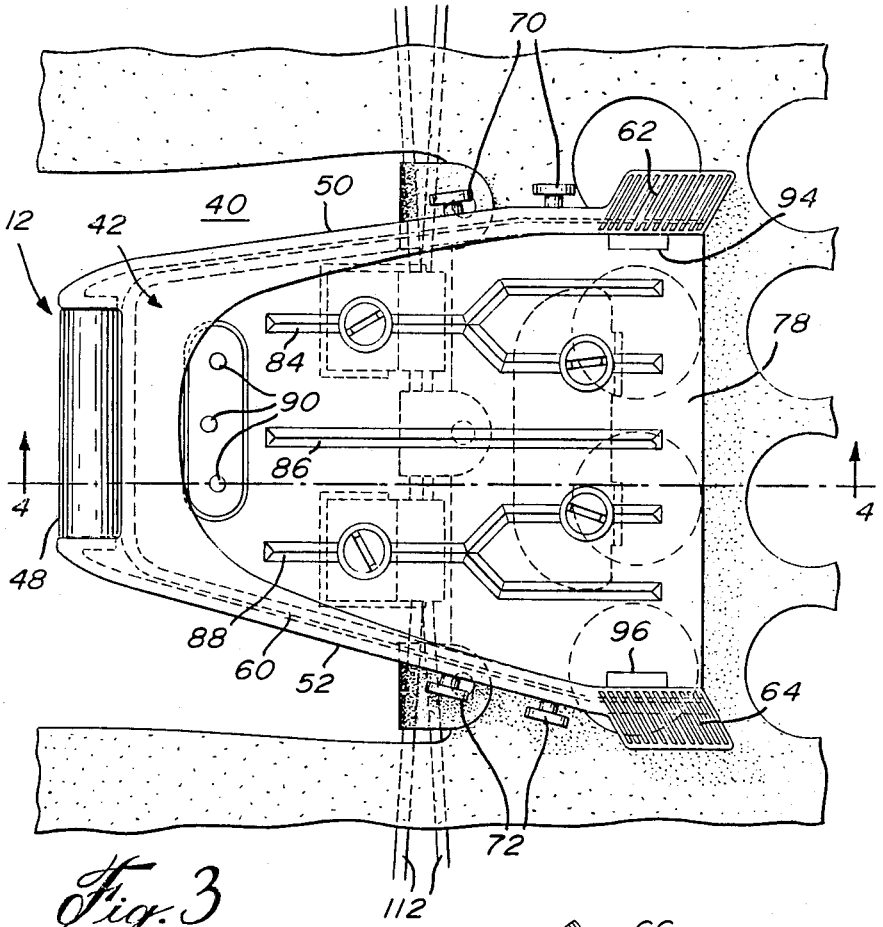
FIG. 3 is an enlarged top view of the harness and adjacent portions of the snowshoe decking.
Figure 4:
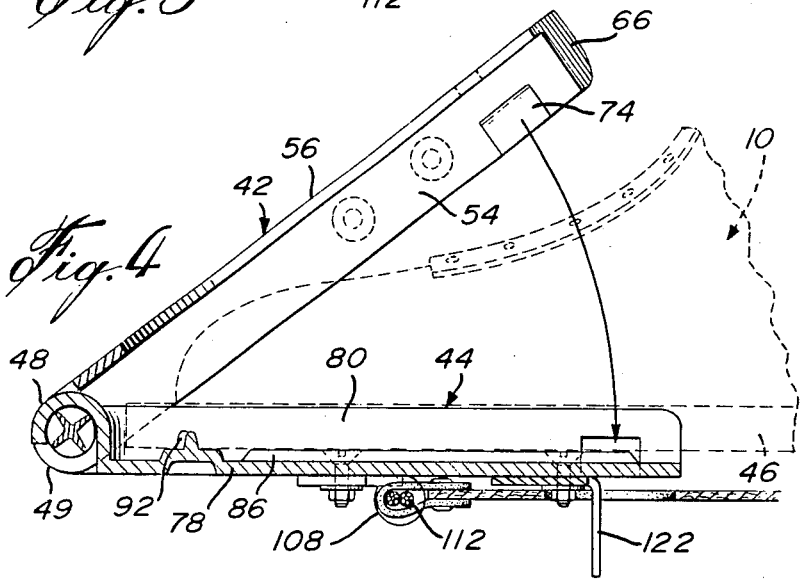
FIG. 4 is a cross-sectional view taken along lines 4—4 of FIG. 3 showing the upper jaw member in the opened position.
Figure 5:
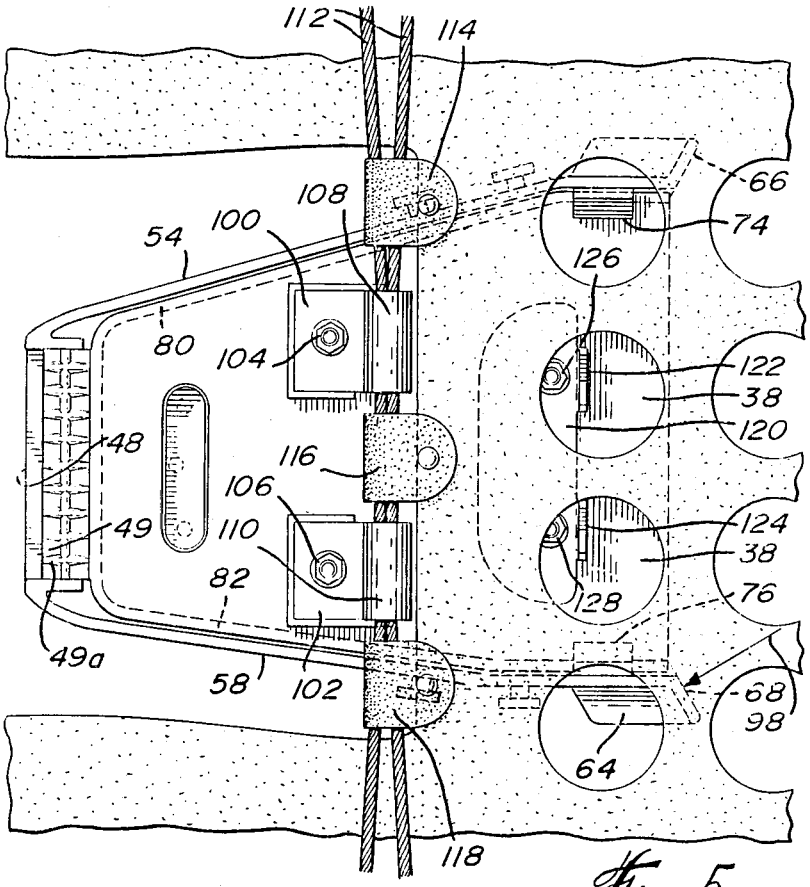
FIG. 5 is a bottom view showing the harness and adjacent portions of the snowshoe decking.

Referring to FIGS. 3, 4 and 5, the harness 12 comprises a U-shaped upper member 42 and a lower plate member 44 acting as jaw members to engage therebetween the front edge portion of the sole 46 of boot 10. The jaw members are pivotably connected at their front end, the lower plate having an incompletely-cylindrical housing 48 into which is engaged (through a snap-in engagement) a front extension 49 of the upper member 42, the extension being formed of a series of spaced disc-like sections 49*a*.

The upper jaw member 42 includes two opposite longitudinal side members 50 and 52. Side member 50 is defined by a vertical wall 54 flanged with a top wall 56; similarly, side member 52 has a vertical wall 58 flanged with a top wall 60. The extremities of side members 50 and 52 include finger-engaging enlarged portions 62, 64 in their top wall portions and 66, 68 in their vertical side wall portions. These enlarged portions are preferably serrated.

On the outer face of each side wall 54, 58 is formed a pair of pins 70, 72 which serve to attach the opposite ends of the strap 16 mentioned above. The strap is made of elastic material, such as rubber, so as to tightly extend over and engage the top front portion of a user's boot. Each side wall has a projection 74, 76, the function of which will be described hereinbelow.

Figure 7:
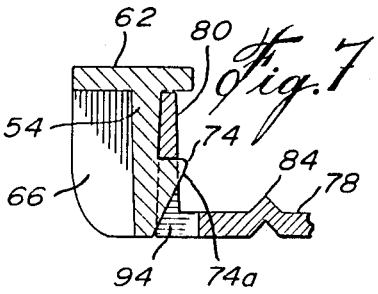
FIG. 7 is an enlarged cross-sectional view taken along lines 7—7 of FIG. 6 and showing the interlocking engagement between the upper and lower jaw members.

The lower jaw plate 44 includes a bottom wall 78 and two opposite longitudinal side walls 80 and 82, which fall within walls 54 and 58 of the upper member when the harness is in an engaging position. The top face of the horizontal wall 78 of the lower jaw plate is provided with a series of longitudinal pointed ribs 84, 86 and 88 of various configurations which serve to break ice or accumulated snow thereon. The top face further includes three integrally formed pins 90 which are adapted to be received in holes (one of which is shown as 92 in FIG. 4) in the sole 46 of the boot as conventionally known in cross-country ski harnesses. The top face further displays, in the rear thereof, a pair of opposite openings 94 and 96, each prolonging upwardly in its associated side wall 54, 56 of the side members of the upper jaw member. These openings 94 and 96 cooperate with projections 74 and 76 to secure the upper and lower jaw members in locking engagement. Preferably, these members are made of plastic material having a certain resiliency so that, as wall 54 is lowered within the lower plate, ramp 74*a* (see FIG. 7) slides along wall 80 forcing inwardly wall 54 until projection 74 thereon snaps back into the opening 94. To disengage the jaw members from one another, pressure is exerted on the side extensions 66 and 68 in the direction of arrows 96 and 98 (see FIG. 5).

Figure 6:
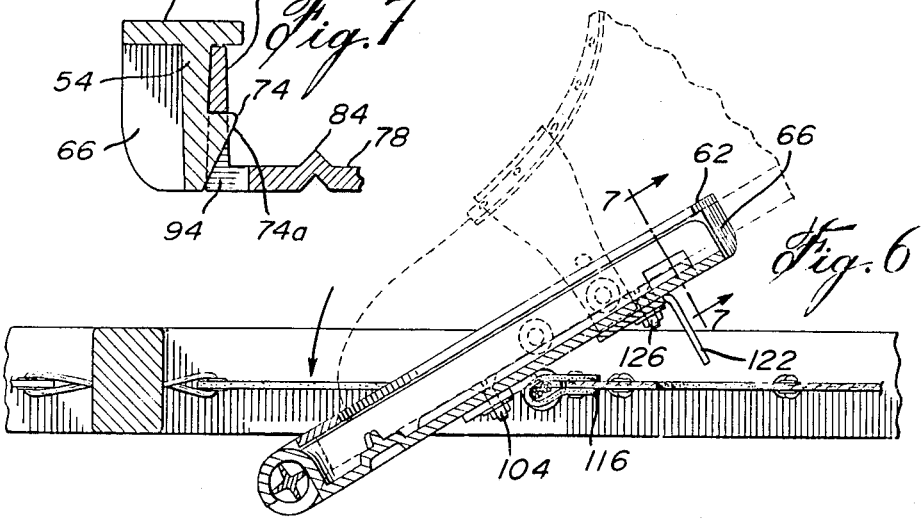
FIG. 6 is a cross-sectional view (similar to that of FIG. 4) showing the harness in closed and pivoted position relative to the snowshoe.

Referring more particularly to FIGS. 5 and 6, a pair of clamps 100 and 102 are attached by means of bolts 104, 106 to the bottom wall 78 of the lower plate. These clamps are each provided with a cylindrical portion 108, 110 each having a pair of parallel cylindrical bores to receive the double pass of a steel cable 112 that passes in the aft area of opening 40. This cable defines a flexible bridging member that serves a dual purpose: first, by extending through the side members 20 and 22 of the peripheral frame structure, it secures the entire frame structure together; secondly, it defines a transverse pivot axis for the harness. The installation of these clamp members on the cable 112 consists in crimping the clamps onto the cable so that no relative movement between the cable and the clamps is permitted. Therefore, any pivotal movement of the harness about the transverse axis causes a twisting effect in the steel cable. The double pass configuration of the cable provides a return force to the cable when twisted; the cable tends to return to its normal parallel position. Referring more particularly to FIG. 5, the decking is also secured to the bridging member 112 by means of three folded connecting elements 114, 116 and 118 attached to the decking at the rear of opening 40.

In a preferred embodiment of invention, the underface of the lower plate wall 78 is provided with a cleat member 120 having a pair of downward projections 122, 124 extending through associated circular holes 38 of the decking. The cleat member 120 is secured to the lower plate by means of bolts 126 and 128.

The snowshoe 14 also includes a heel member 130 mounted to the decking. To the underside of the heel member and located under the decking is secured, by means of fasteners 132, a cleat member identical in construction to cleat member 120, displaying a pair of downwardly extending portions 134 (see FIG. 1).

Although the invention has been described above in connection with a preferred embodiment, it is evident that it may be refined and modified in various ways. It is therefore wished to be understood that the present invention should not be limited in interpretation, except by the terms of the following claims.

The embodiments of the invention in which an exclusive property or privilege is claimed are defined as follows:

1. In combination, (a) a snowshoe comprising:

(i) a frame structure including a peripheral frame;

(ii) a decking carried by said structure; said decking including a toe-receiving opening; and (iii) a flexible bridging member extending transversely of said peripheral frame and defining a transverse axis; said member having opposite ends engaging the peripheral frame and transversing said opening in the aft area thereof;

(b) a harness fixedly secured to said bridging member, comprising:
(i) a lower jaw member adapted to receive, on an upper face thereof, the front sole portion of a user's boot;
(ii) clamp means fixed to the underface of said lower jaw member securing said harness to said bridging member;
(iii) an upper jaw member pivotably connected, at the fore end thereof, to said lower jaw member and cooperating therewith for engaging said front sole portion along the peripheral edge thereof; and
(iv) cooperating means on said lower and upper jaw members for maintaining said harness in engagement with said edge of said front sole portion; and
(c) a strap having opposite ends thereof attached to said harness and being adapted to extend over and secure a boot when engaged in said jaw members, whereby, during use, said boot engaged in said jaw members and secured by said strap, pivots about said transverse axis, with front portions of said harness and said boot pivoting in the opening of said decking.

2. A combination as defined in claim 1, wherein said upper jaw member defines a U-shaped frame with two opposite longitudinal side members, each side member having a vertical wall flanged to define a top wall, said top walls contacting the edge of said front sole portion of a user's boot.

3. A combination as defined in claim 2, wherein said lower jaw member includes two opposite longitudinal side walls enclosing the edge of the front sole portion of a user's boot; said cooperating means including, at aft extremities of said side walls, openings receiving the cooperating means of said upper jaw member.

4. A combination as defined in claim 3, wherein said cooperating means of said upper jaw member include, at aft extremities of said side walls, projection means engageable in said openings of said lower jaw member.

5. A combination as defined in claim 4, wherein said projection means are made of a resilient material and include a ramp adapted to slide along the side wall of said lower jaw member prior to be engaged in said openings.

6. A combination as defined in claim 5, wherein aft extremities of said top wall of said upper jaw member include enlarged finger-receiving portions to assist a user in the engagement of the upper jaw member with the lower jaw member.

7. A combination as defined in claim 5, wherein said aft extremities of said side walls of said side members include finger-receiving extensions to assist a user in the disengagement of the upper jaw member from the lower jaw member for the removal of a user's boot from said harness.

8. A combination as defined in claim 6, wherein said finger-receiving portions are serrated.

9. A combination as defined in claim 7, wherein said finger-receiving extensions are serrated.

10. A combination as defined in claim 1, further comprising cleat means secured to said underface of said lower jaw member; said cleat means extending below said decking.

11. A combination as defined in claim 10, further comprising a heel member mounted to said decking for receiving the heel of a user's boot.

12. A combination as defined in claim 11, further comprising cleat means secured to the underface of said heel member; said cleat means extending below said decking.

13. A combination as defined in claim 12, wherein said decking comprises a surface having a series of holes disposed thereon; said cleat means on said lower jaw member of said harness and said cleat means on said heel member including downwardly projecting portions extending through associated holes of said decking.

14. A combination as defined in claim 2, wherein said side walls of said side members of said upper jaw member comprise pin means for attaching said strap thereto.

15. A combination as defined in claim 14, wherein each said side wall includes two of said pin means for adjustment to various sizes of user boots.

16. A combination as defined in claim 3, wherein the top face of said lower jaw member comprises a plurality of pointed ribs extending longitudinally thereon.

17. A combination as defined in claim 16, wherein the fore part of the top face of the lower jaw member comprises a series of upwardly projecting pins adapted to engage corresponding holes in the sole of a user's boot.

18. A combination as defined in claim 1, wherein said flexible bridging member consists of a steel cable.

19. A combination as defined in claim 18, wherein said steel cable defines a double pass; said clamp means including portions having a pair of parallel bores receiving said double pass; said clamp means being crimped onto said cable.

20. A combination as defined in claim 1, wherein said frame structure includes two longitudinally spaced rigid cross-members dividing said decking into a front section, a middle section and a rear section; said opening being located in the fore part of said middle section.

* * * * *